US009589776B2

(12) United States Patent
Chaudhary et al.

(10) Patent No.: US 9,589,776 B2
(45) Date of Patent: Mar. 7, 2017

(54) RUGGEDIZED ADVANCED IDENTIFICATION MASS SPECTROMETER

(71) Applicant: SRI INTERNATIONAL, Menlo Park, CA (US)

(72) Inventors: Ashish Chaudhary, Safety Harbor, FL (US); Friso Van Amerom, Hyattsville, MD (US); R. Timothy Short, St. Petersburg, FL (US)

(73) Assignee: SRI International, Menlo Park, CA (US)

( * ) Notice: Subject to any disclaimer, the term of this patent is extended or adjusted under 35 U.S.C. 154(b) by 0 days.

(21) Appl. No.: 15/070,433

(22) Filed: Mar. 15, 2016

(65) Prior Publication Data

US 2016/0276144 A1 Sep. 22, 2016

Related U.S. Application Data

(60) Provisional application No. 62/133,805, filed on Mar. 16, 2015.

(51) Int. Cl.
*H01J 49/00* (2006.01)
*H01J 49/24* (2006.01)

(52) U.S. Cl.
CPC ..... *H01J 49/0027* (2013.01); *H01J 49/0013* (2013.01); *H01J 49/0054* (2013.01); *H01J 49/0059* (2013.01); *H01J 49/24* (2013.01)

(58) Field of Classification Search
USPC ..... 250/281, 282, 288
See application file for complete search history.

(56) References Cited

U.S. PATENT DOCUMENTS 8,431,899 B2 4/2013 Zimmermann, et al.
2015/0185190 A1* 7/2015 Zhang ..... G01N 27/64 250/288

FOREIGN PATENT DOCUMENTS

EP 1704578 B1 4/2011
EP 2363877 A1 9/2011
WO 2014114803 A1 7/2014

OTHER PUBLICATIONS

ISR & Written Opinion, PCT/US16/23236, mailed Jun. 20, 2016, 8 pages.

* cited by examiner

*Primary Examiner* — Kiet T Nguyen
(74) *Attorney, Agent, or Firm* — Marger Johnson

(57) ABSTRACT

A dual-ionization mass spectrometer includes a first mass spectrometer module forming a hard ionization mass spectrometer, a second mass spectrometer forming a soft ionization mass spectrometer, a vacuum ultraviolet light source positioned between the first and second modules, a housing encompassing the first and second sets of plates and the light source, and an inlet positioned to receive a sample of an analyte and provide it to at least one of the sets of plates. A method of detecting a substance includes receiving a sample of an analyte into a housing through an inlet, performing soft ionization mass spectrometry on the sample with a soft ionization mass spectrometer in the housing, performing hard ionization spectrometry on the sample with a hard ionization spectrometer in the housing if needed, and generating a detection result from at least one of the soft ionization spectrometry and the hard ionization spectrometry.

19 Claims, 9 Drawing Sheets

RUGGEDIZED ADVANCED IDENTIFICATION MASS SPECTROMETER

RELATED APPLICATIONS

This application claims priority to U.S. Provisional Patent Application No. 62/133,805, filed Mar. 16, 2015.

BACKGROUND

Mass spectrometers perform chemical detection, allowing the user to determine what substances are present in any given environment. Typically, mass spectrometers have a relatively large footprint with an ionizer, a mass analyzer and a detector. The instrument typically has several components that are fragile including the ionizer, such as a filament to generate electrons, roughing and turbo pumps and require a relatively high amount of power. Additionally, the mass spectrometers that use RF ion traps, called ion trap mass spectrometers, require high RF voltages to perform the mass analysis. The electronics foot print and power required to generate these high RF voltages further add to the complexity and power requirements of the MS infrastructure.

These requirements make it difficult to produce portable, low-power mass spectrometers. However, it is possible to design low-power and low-voltage miniature MS components, such as the ionizer, mass analyzer etc., to reduce the size and power requirements to enable miniaturized mass spectrometers.

Additionally, mass analysis of environments that generate complex spectra with many interfering peaks from the matrix can lead to incorrect identification resulting in false positives. To handle such convoluted mass spectra, typically a front end separation stage is used, such as gas chromatograph (GC) or liquid chromatograph (LC). This additional stage further increases the overall footprint of the chemical sensing platform, while also slowing the response time and increasing maintenance. To circumvent this problem, effective mass analysis scheme can be developed to enhance the confidence of chemical identification even with a complex matrix signal, thus relieving the requirements of the performance specifications of the separation stage, and in some cases eliminating the need for them.

SUMMARY

One embodiment is a dual-ionization mass spectrometer including a first mass spectrometer module forming a hard ionization mass spectrometer, a second mass spectrometer forming a soft ionization mass spectrometer, a vacuum ultraviolet light source positioned between the first and second modules, a housing encompassing the first and second sets of plates and the light source, and an inlet positioned to receive a sample of an analyte and provide it to at least one of the sets of plates.

Another embodiment is a method of detecting a substance including receiving a sample of an analyte into a housing through an inlet, performing soft ionization mass spectrometry on the sample with a soft ionization mass spectrometer in the housing, performing hard ionization spectrometry on the sample with a hard ionization spectrometer in the housing if needed, and generating a detection result from at least one of the soft ionization spectrometry and the hard ionization spectrometry.

DETAILED DESCRIPTION OF THE EMBODIMENTS

Figure 1:
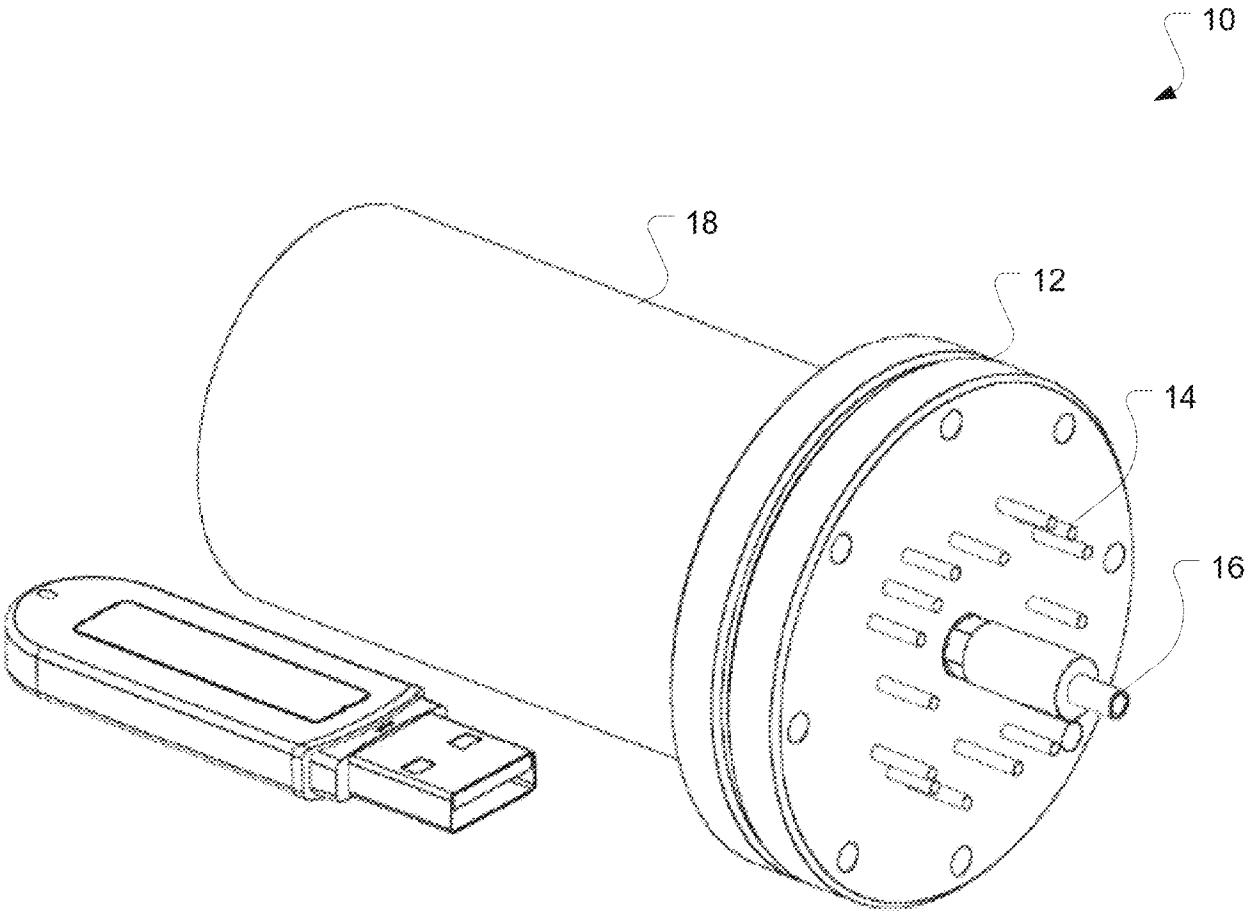
FIG. 1 shows an embodiment of a miniaturized mass spectrometer.

FIG. 1 shows an embodiment of the mass spectrometer assembly 10. All mass spectrometer ion optics components are assembled on a vacuum flange 12. The vacuum flange can be connected to a miniature vacuum housing 18, which, in turn, is connected to vacuum pumps to generate and maintain high vacuum. External connections, such as metal connecting rods 14, provide connections to internal components, while still allowing preservation of the vacuum. Inlet 16 allows introduction of the analyte into the spectrometer. The embodiment shown in FIG. 1 merely represents one possible option and location of an inlet. No limitation to this type of inlet is intended nor should any be assumed.

These components are mounted into the vacuum flange 12, which is removable to allow access to the interior. The pump may represent more than one pump, such as a roughing and a turbo pump. With the much smaller footprint of the mass spectrometer ion optics and integration discussed below, a much smaller vacuum chamber may result in reduced flow rates thereby allowing the ability to use smaller vacuum pumps, such as miniature or micro vacuum pumps, etc. For reference, a typical USB thumb drive is shown for a size comparison.

Figure 2:
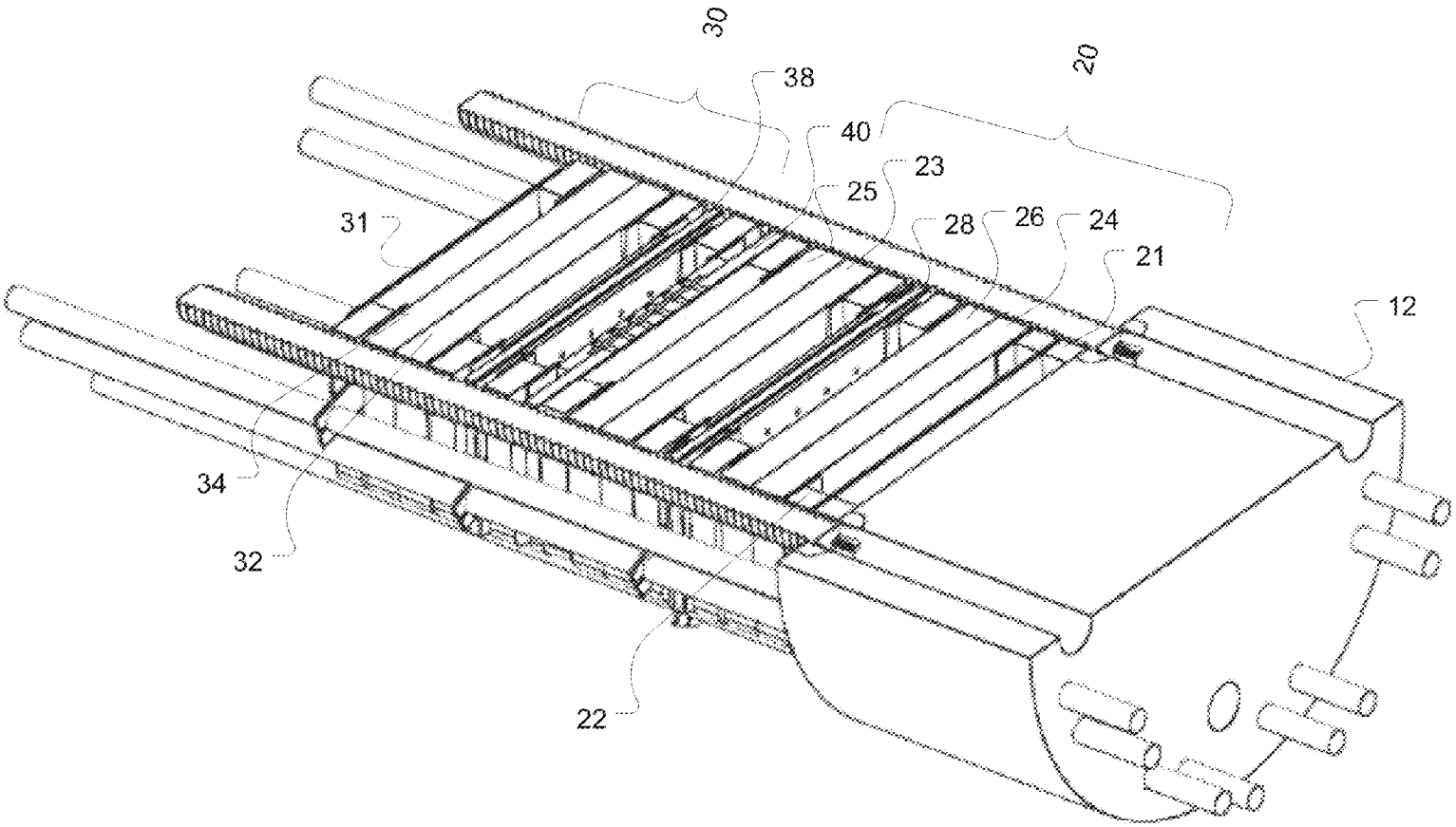
FIG. 2 shows an internal cross-sectional view of a miniaturized mass spectrometer.

FIG. 2 shows a detailed view of one embodiment of the mass spectrometer 10. This embodiment employs dual ionization mass spectrometry to obtain complementary mass spectral data. The dual ionization methods includes a hard ionization scheme and a soft ionization scheme. For example, using electron impact ionization as hard ionization, fragmentation of the parent molecule can be analyzed. To induce soft ionization of molecules, which results in minimal fragmentation and prominent molecular peak, photoionization via vacuum ultraviolet (VUV) light of appropriate wavelength and photon energy can be used. The combination and interactive use of hard ionization and soft ionization mass spectral data can be used by smart algorithms to enhance the chemical identification, having low false positives.

FIG. 2 illustrates all the ion optics components required to perform dual ionization mass spectrometry in an ultra-low footprint. Broadly speaking, there are two separate sets of ion optics components, defined here as ionizer, mass analyzer and ion detector, to perform electron impact ionization mass spectrometry and photoionization mass spectrometry independently, simultaneously, or sequentially as needed. In this embodiment, most components are flat planar form, which can be mounted, aligned and compressed together with necessary dielectric spacers such as 22 in FIG. 2, in between for electrical isolation and appropriate clearance for gas conductance. The discussion now turns to one embodiment of an ion optics package in detail.

Figure 4:
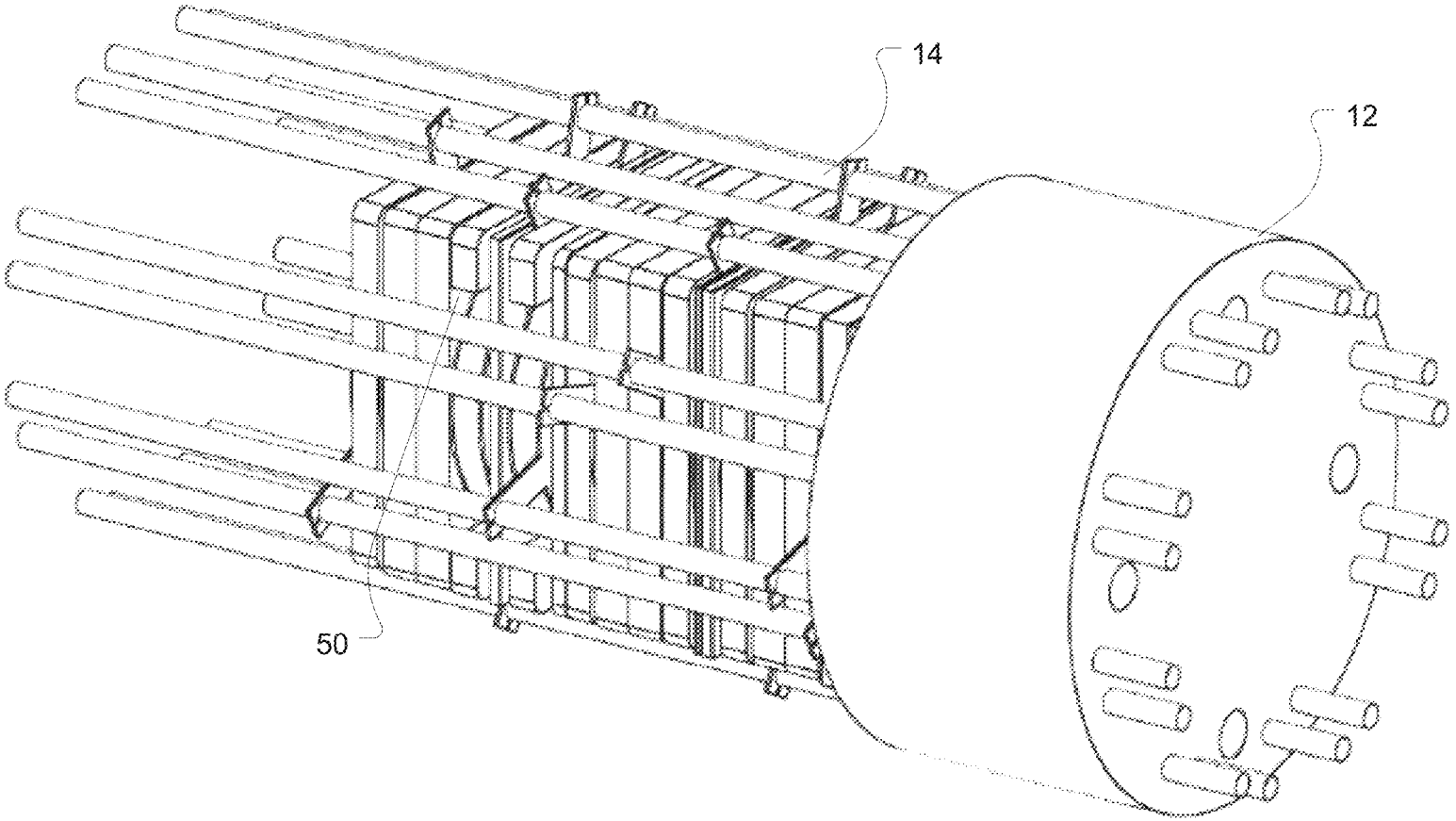
FIG. 4 shows another view of the miniaturized mass spectrometer.

FIG. 2 shows a cross sectional view and FIG. 4 shows a view with the alignment threaded studs removed for clarity. These illustrate one embodiment of the ion optics components and their respective position with respect to each other. The first module 20 performs the hard ionization, such as electron-impact ionization mass spectrometry (EI-MS), and the second module 30 performs the soft ionization, in this case photoionization mass spectrometry (PI-MS). Plate 40 consists of a vacuum ultraviolet (VUV) source array chip physically matched with a micro ion trap array chip plates 38 and 28, discussed in more detail in FIGS. 5 and 6.

In the embodiment shown in FIGS. 2 and 4, the plate 40 has a VUV transparent window on both sides, resulting in extraction of VUV photons on both sides of the plate. In another embodiment (not shown here), two separate plates 40 can be used, mounted back to back. The VUV source chip and the micro ion trap array chip may be formed using microelectromechanical systems (MEMS) techniques applied to silicon wafers to form the necessary plates. The plates used to perform EI-MS consist of the VUV array source plate 40, an electron multiplier consisting of a set of two microchannel plates (MCPs), 23 and 25, a micro ion trap array, 28 and another set of two MCPs 24 and 26 for ion-current amplification and an anode plate 21 for ion detection.

Figure 3:
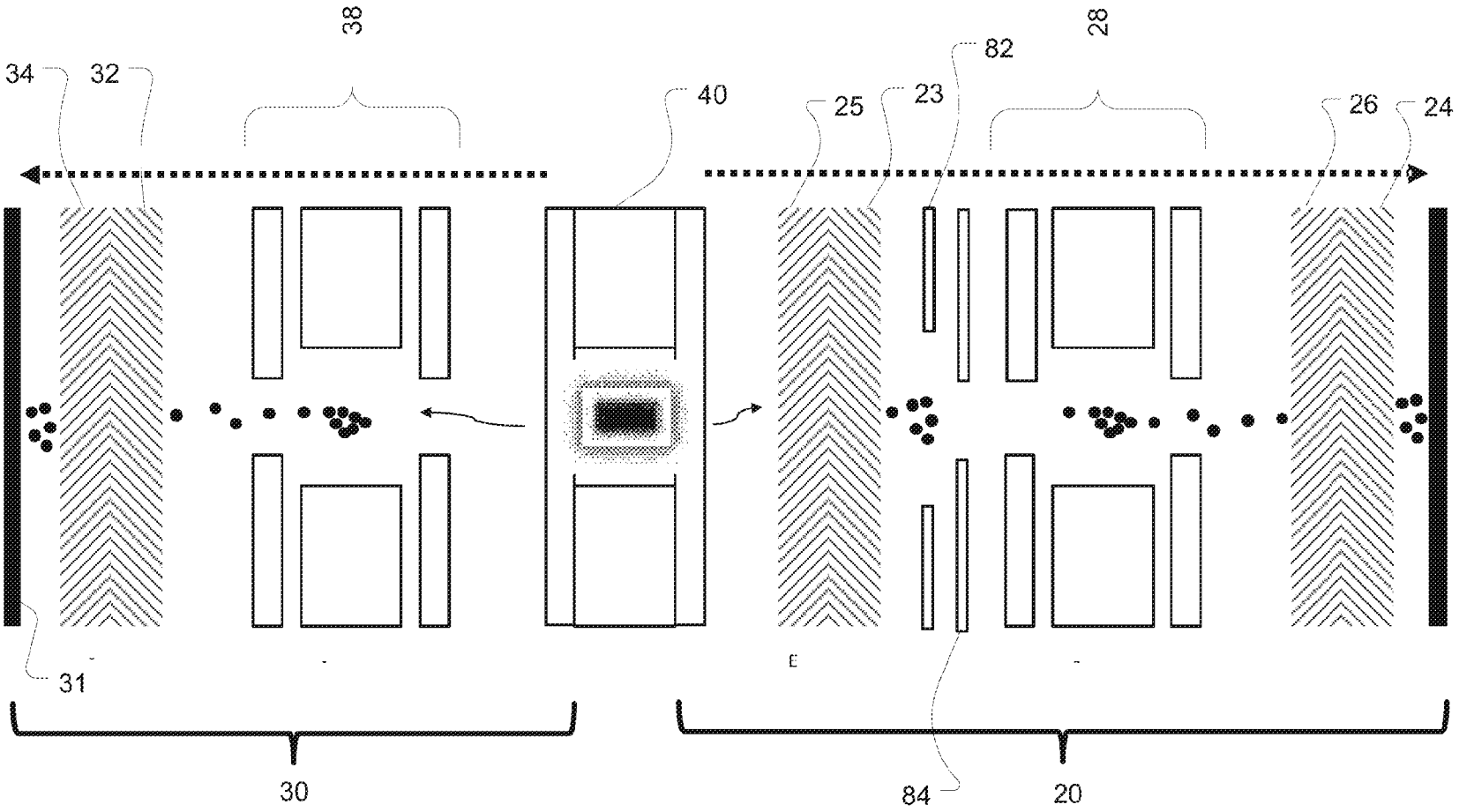
FIG. 3 shows a block diagram of one embodiment of a dual-ionization mass spectrometer scheme.

FIG. 3 illustrates the detailed working of one embodiment EI-MS. The VUV extracted from plate 40 impinges on the first MCP 25 and generates primary electrons which are then accelerated through the MCP set of plates 25 and 23 to cause electron multiplication via appropriate high voltages applied across plates 25 and 23. In another embodiment, a set of 3 MCPs instead of 2 may be used for higher electron currents. The broad beam of electrons emitted from the backside of plate 23 is guided towards the center of each trap in plate 28. In one embodiment, an electron lens system may be used to focus the electrons from a larger flux to the center of each trap. This is described in detail later and is depicted by FIGS. 6 and 7.

Figure 6:
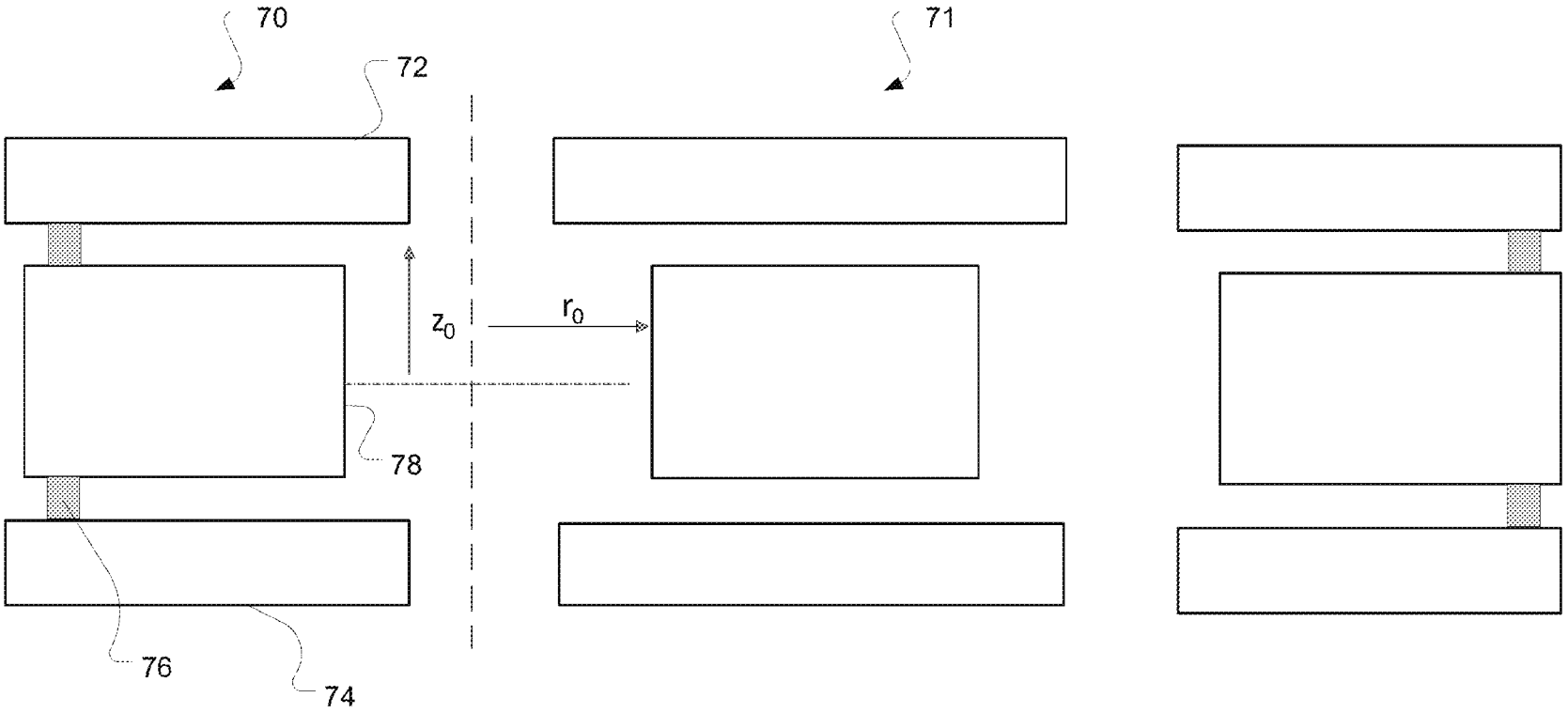
FIG. 6 shows a side view of an array of micro ion traps.
Figure 7:
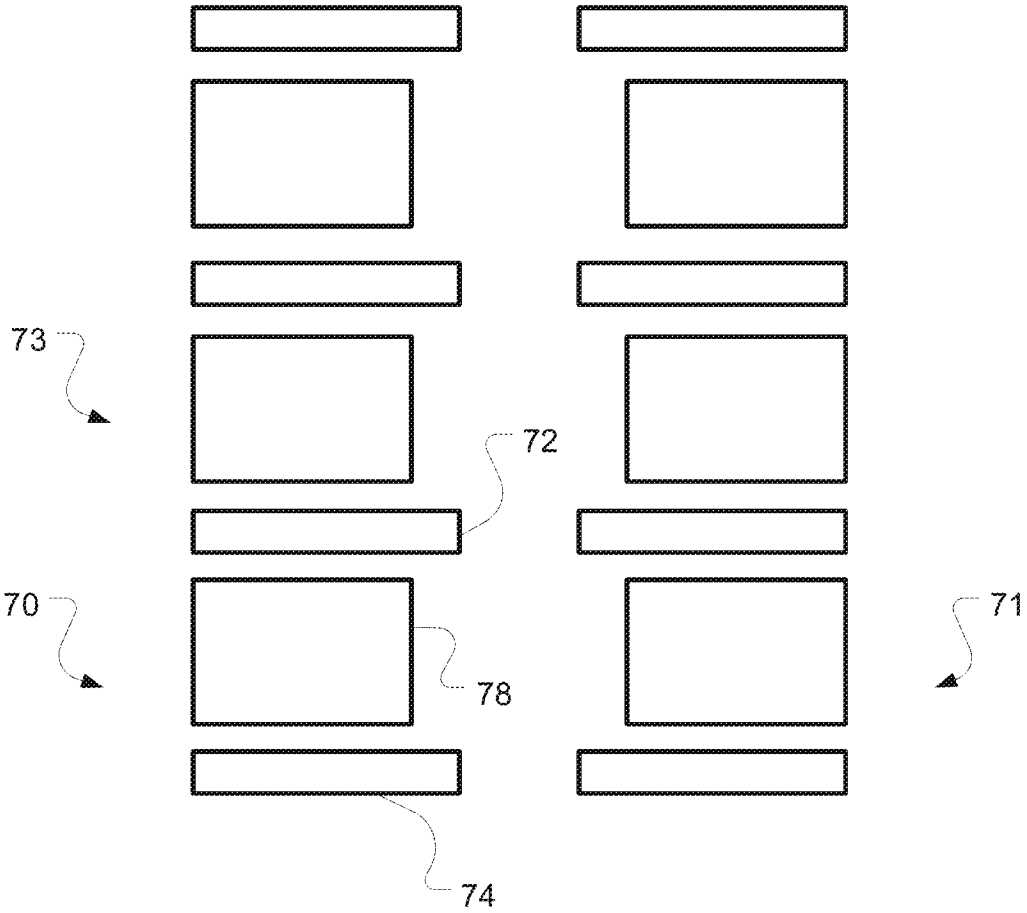
FIG. 7 shows an embodiment of scalability of micro ion traps.

Electrons passing through the micro ion traps generates ions and these ions are mass analyzed by application of appropriate RF potentials applied on the 3 electrodes of the micro ion trap array chip 28 discussed in more detail in FIG. 6. The ion packets ejected from the micro ion trap array chip impinge on the first MCP 26 of the ion detection side 20 thereby generating primary electrons. The electrons are multiplied in a scheme similar to plates 25 and 23. The amplified electron signal is then collected on the anode plate 21 and displayed on the oscilloscope to generate the mass spectrum. Dielectric spacers such as 22 provide the necessary separation for the plates to avoid electrical breakdown, and C-shaped dielectric spacers 50 such as those of FIG. 4 allow separation and gaps for gas conductance. Thin metal plates, which may be custom-designed for each ion optics component, are sandwiched between all the active components to provide the necessary electrical signals. The feedthroughs may be positioned in a circular pattern and different heights on the vacuum side to maintain minimum electrical cross-talk between the components.

The scheme and integration style similar to that described for EI-MS is used to perform PI-MS for the set of plates 30. To generate ions via photoionization, the VUV source 40 mounted directly next to the micro ion trap array 38 delivers VUV photons at the center of each micro ion trap. MCP plates 32 and 34 are used to amplify the ion signal ejected from 38 and collected on the anode 31 for mass spectrum. Electrical spacers are used in the PI-MS are not labeled here for simplicity.

Because of the use of the MCPs for electron generation, the need for a filament in the ionizer has been eliminated. This allows the mass spectrometer to become 'ruggedized' meaning that any forces/vibrations applied to it will not break or disrupt its operation. No breakable, fragile filament exists anymore.

FIG. 4 shows an alternative view of the mass spectrometer. With the tightly-packed plates, space needs to be built in to allow gas conductance of the analyte for analysis. In the embodiment of FIG. 4, C-shaped spacers such as 50 provide these gaps. One can also see the connections between the various plates and the electrical connection rods 14.

Figure 5:
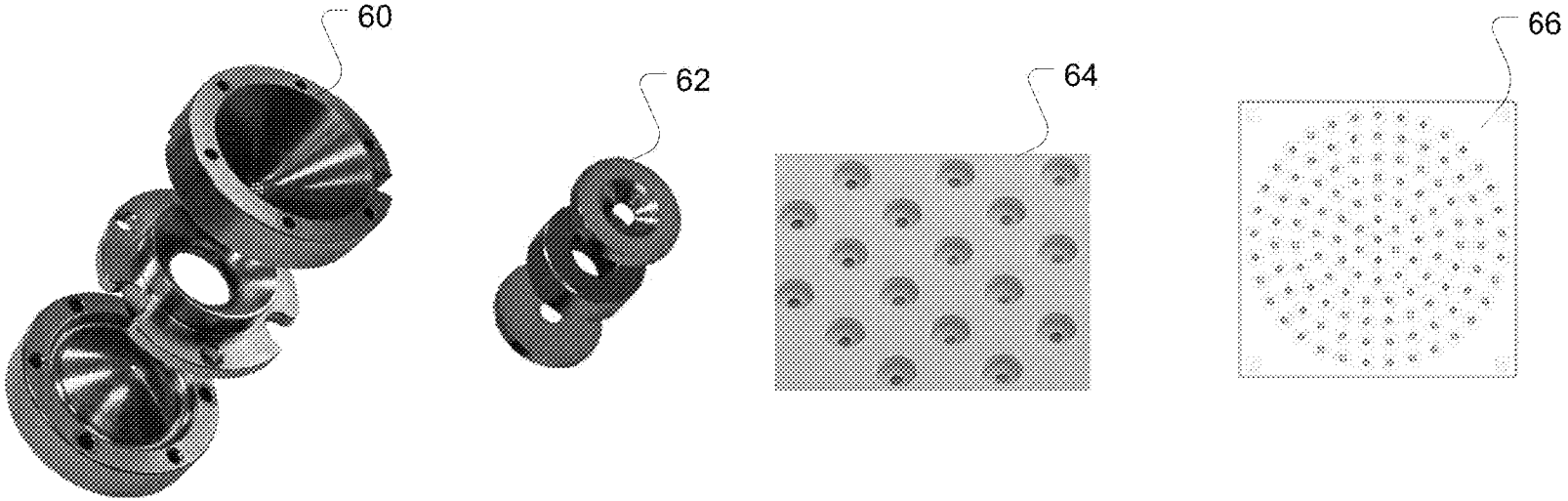
FIG. 5 shows an embodiment of a micro ion array trap.

One of the unique elements of the mass spectrometers used here is their miniaturization. The spectrometers provide ultra-low power and low-voltage mass analysis. One aspect includes reduction in the size of the radius of the RF 3D ion traps. FIG. 5 shows an evolution of these traps that has resulted in the current implementations. These enable the low-power requirements. The relevant dimensions are radius of the trap, $r_0$, the mass, m, the RF voltage $V_{rf}$, the frequency, $\Omega$, the quadrupole coefficient, $A_2$, the charge, e and an operation parameter, $q_z$. The RF voltage is found by:

$$V_{rf} = \frac{m q_z r_0^2 \Omega^2}{4 A_2 e}.$$

In FIG. 5, the quadrupole ion trap 60 has a radius of 1 cm. It is relatively high power, using approximately 10 W, needs high RF voltages and requires complex electronics and has limited opportunities for miniaturization. The miniature cylindrical ion trap 62 has a radius of 0.2 cm. It has simplified geometry with a similar trapping potential as the larger traps, and is easier to miniaturize. However, the relatively large radius still results in relatively high power consumption.

The component 64 consists of an array of micro cylindrical ion traps micromachined in silicon wafer with high precision. It uses larger dielectric gaps to increase the breakdown voltage thereby extending the mass range. In one embodiment, the radius is 350 micrometers and has 25 traps, but generally the traps will have sub-millimeter dimensions. The component 66 used in FIG. 5 consists of a high-density micro cylindrical ion trap array. It offers increased sensitivity via scalability, and the sensitivity is increased via scalability. In the embodiment 66 of FIG. 5 the traps have a radius of 315 micrometers and 120 of them can fit into a 2 square-cm chip. Referring to the equation above, one can see that the reduced radius results in lower RF voltage. This contributes to the overall miniaturization of the ion optics package compared to conventionally large traps, while also reducing the electronics and battery package.

The above mentioned EI-MS and PI-MS ion optics are also a scalable design with regard to scalability of the micro ion trap arrays in two-dimensional and three-dimensional arrays. The MCP used for electron generation and ion detection are available in different shapes and sizes and allow an easy path for scalability of the entire ion optics package. Localized sources of VUV in the VUV array plate allows for a simple two-dimensional expansion of the footprint without the need to focus photons.

Although the implementation shown in FIG. 5 uses a multitude of micro traps for simultaneously operation, it is conceivable that several sub-arrays of different size of traps can be incorporated in a single chip. With the application of same RF voltages, these sub-arrays can be tuned for analyzing different masses, one or a small range. This method allows parallel mass analysis thereby decreasing the response time and allowing higher dynamic range for the targeted species.

In another implementation, the VUV source can be configured for different wavelengths, photon energy, and cause selective ionization across the sub-arrays of these micro traps for targeted screening and/or chemical class screening. For example, explosive ionization might need slightly lower photon energy, and therefore longer wavelength, than ionization of common toxic industrial compounds such as chlorine and chemical warfare agents such as sarin.

As mentioned above, MEMS techniques can manufacture these miniature RF 3D ion traps with high precision. These processes also offer high uniformity of ion trap structures across the chip that is critical to maintain mass resolution of the signal collectively sampled across the array. In one approach, three electrodes of the ion trap are built on three separate silicon wafers. This approach allows flexibility in the ion trap design, such as dielectric gaps to maintain low capacitance of the ion trap array. These small chip arrays enable the miniaturization of the spectrometer.

FIG. 6 shows a cross-sectional view of an embodiment of a micro ion trap array design. The ion trap has a ring electrode 78 between endplate electrodes 72 and 74 all micromachined in silicon wafers. The electrodes have gaps formed from dielectric spaces, such as 76. While not seen in this view, the dielectric spacers can be very small islands creating an open assembly of 3-electrodes thereby allowing gas conductance. RF voltage is applied to the ring electrode. The endplate electrodes may be grounded or may receive an additional small auxiliary voltage. The small auxiliary voltage may enhance resolution. In one design implementation, shallow posts and pits incorporated in the ring and endplate electrodes allow interlocking of the 3 electrodes resulting in a highly repeatable and reliable alignment scheme. This eliminates the need for an external dielectric spacer. This approach enables an ion trap array design shown in FIG. 6 which is scalable, containing any number of traps in a two-dimensional array.

FIG. 7 shows an example of scalability. Similar to FIG. 6, the ion trap 70 can scale two-dimensionally with the addition of ion trap array 71. It is also possible to scale the array in three dimensions. As shown in FIG. 7, the traps scale horizontally as shown by 71. That 'layer' of 70 and 71 also would also extend back into the page. In addition, the traps can extend in a third dimension essentially stacking traps such as 73 on top of 70. The two traps would share the endplate electrode 72.

For a perfectly symmetrical ion trap structure, the ions eject on both sides while the detector is installed only on one side, keeping the other side open for incoming electrons/photons for ionization. It is also possible, however, to fine tune the geometry of the trap. In the embodiments here the wall verticality of the inside cylindrical wall of the ring electrode can be tuned, such as by tapering the walls, to cause preferential ejection of ions on one side without causing any noticeable degradation in the mass resolution.

Selective metallization of the 3 electrode plates of the ion trap array, such as accomplished by a combination of photolithography and electron-beam evaporation and RF/DC sputtering etc., allows for higher breakdown voltages and reduced capacitance for a given dielectric gap. In this case, the silicon wafer has an insulating silicon dioxide layer of few micrometers deposited or thermally grown after etching the through-holes. The larger dielectric gaps also allow for higher breakdown voltages and reduced capacitance. Broader mass range analysis requires application of higher RF voltages. Other simpler and faster methods of selective metallization, such as blanket metallization using a shadow mask, also allow a solution path while reducing fabrication steps.

Figure 8:
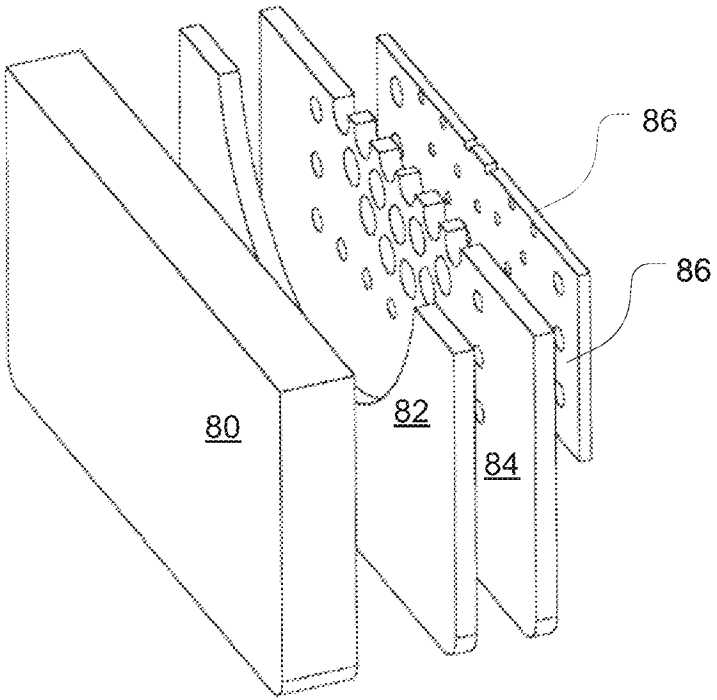
FIG. 8 shows an exploded view of one embodiment of electron lens optics.

The traps receive electrons from a focused electron flux, where the focusing lens plate system channels the electrons from a large area to the entrance of the micro ion traps in the end plate. FIG. 8 shows an embodiment of such an arrangement. The MCP 80 passes the electron flux to the first lens 82, which in turn focuses the electron flux to the second lens plate 84, which in turn directs the electrons to the ion traps in the endplate 86. In another embodiment, 82 can be replaced by a single aperture lens to focus electron flux from a much larger MCP area to the ion trap.

Figure 9:
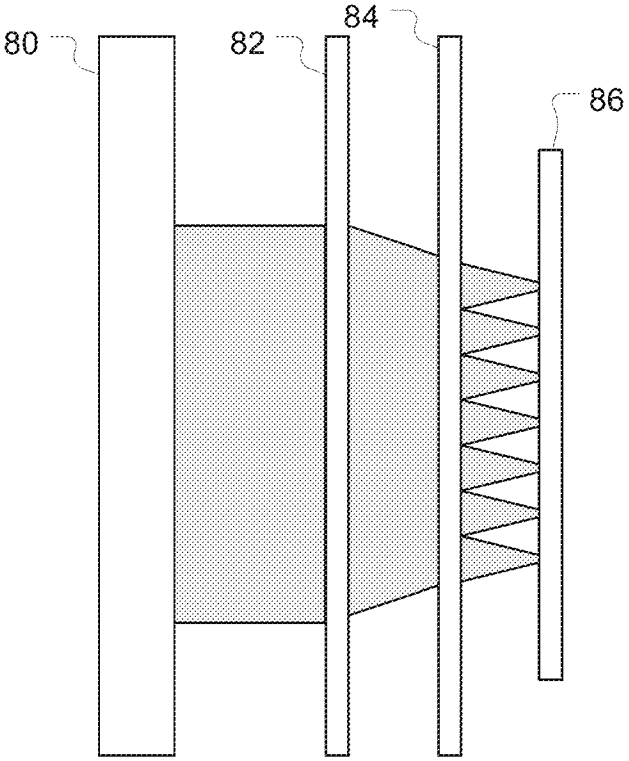
FIG. 9 shows a side view of another embodiment of electron lens optics illustrating electron path during focusing.

FIG. 9 shows a side view of this arrangement. As can be seen, the electron flux comes through the microchannel plate 80 and is focused a first time by the first lens 82 and then by second lens 84 until it ultimately reaches the micro ion trap 86. Referring back to FIG. 8, the lens plates 82 and 84 may include arrays of lenses that have different lens sizes and different dimensions. This may provide a range of sensitivities for a broad beam electron source as used in these embodiments.

Figure 10:
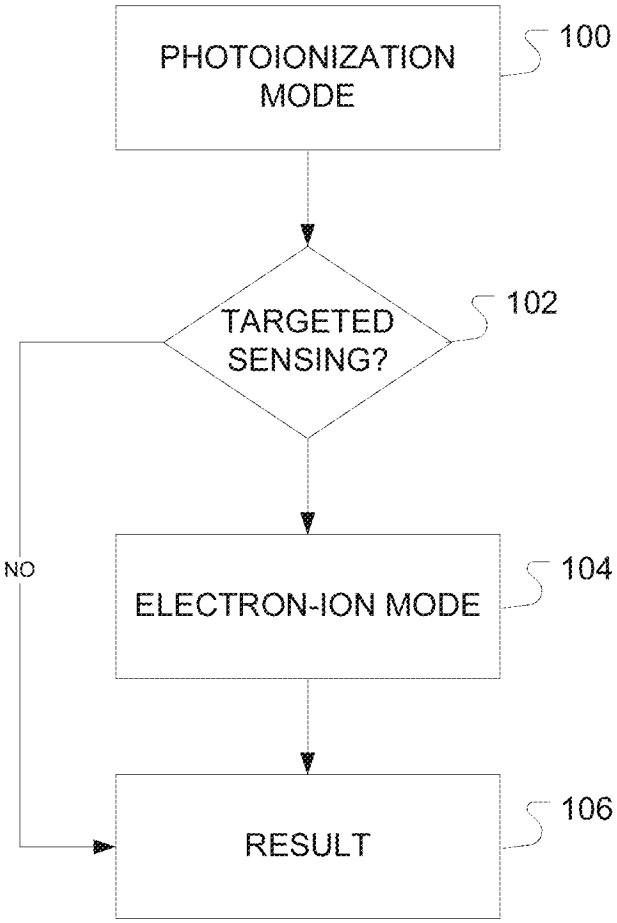
FIG. 10 shows a flowchart of an embodiment of a method of performing mass spectrometry using a dual and complementary ionization source.

The ability to perform both hard ionization such as EI-MS and soft ionization such as PI-MS in such as small unit allows for highly reliable detection. FIG. 10 shows an embodiment of a method of performing mass spectrometry. The spectrometers in the embodiments discussed here are EI-MS and PI-MS. These are merely examples of hard ionization and soft ionization, respectively. No limitation to these particular types of hard and soft ionization is intended nor should any be implied.

The hard ionization, in this case, EI, source is implemented using MEMS technology, discussed above. Localized beams of electrons are generated using a VUV source chip and electron multiplier stage. Other wavelengths and sources can also be used depending upon a desired application in mass spectrometry. In one embodiment, one or more commercially available UV LEDs, such as 255 nm, can be used in place of the VUV source. In this embodiment, the electron-lens focusing will allow taking flux from a larger exposed area to be focused to a small spot size.

With this dual and complementary mode, the detection operation becomes more flexible and more accurate as shown in FIG. 10. The method of advanced identification in miniature mass spectrometer (AIMMS) begins with photoionization at 100. This may be referred to as the screening mode. If all that is needed is a quick screening of the environment to determine the presence of a particular chemical, the process may end there. If the application is a targeted sensing, as shown in 102, the device may then move into the electron-impact ionization mode. A positive hit in the PI-MS mode can then be used to confirm the presence of the daughter molecules with the EI-MS mode at 84. Ultimately, the mass spectrometer reaches a result at 86.

In another detection scheme, a multi-wavelength PI source would be incorporated. In this version of the photoionization mode 100, photoionization and mass analysis would occur iteratively with increasing, shorter wavelength, photon energy can be carried out for deconvolution of complicated environment such as that of hydrocarbon sensing. This approach can be very useful for natural gas and oil analysis The above embodiments provide a ruggedized, miniature mass spectrometer that uses relatively low-power and low-voltages. This directly enables smaller electronics footprint and reduces battery footprint. The miniature MS cartridge, one that is enabled by the above mentioned components drastically reduces the unused vacuum cell volume thereby reducing the effective flow rate required.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A dual-ionization mass spectrometer, comprising:

a first mass spectrometer module forming a hard ionization mass spectrometer;

a second mass spectrometer module forming a soft ionization mass spectrometer;

a vacuum ultraviolet light source positioned between the first and second mass spectrometers;

a housing encompassing first and second sets of plates and the light source; and an inlet positioned to receive a sample of an analyte and provide it to at least one of the first and second modules.

2. The mass spectrometer of claim 1, wherein the first mass spectrometer module comprises micro-channel plates forming an electron impact ionization.

3. The mass spectrometer of claim 2, wherein the electron impact ionization mass spectrometer includes two ion detection plates, two ionization plates, a micro ion trap array plate, and an anode.

4. The mass spectrometer of claim 1, wherein the second mass spectrometer comprises localized micro-vacuum ultraviolet sources forming a photoionization mass spectrometer.

5. The mass spectrometer of claim 4, wherein the photoionization mass spectrometer includes two ion detection plates, a micro ion trap array plate, and an anode.

6. The mass spectrometer of claim 5, wherein the micro ion trap array plate includes micromachined posts arranged to align the micro ion trap array plate with ion optic plates.

7. The mass spectrometer of claim 5, wherein ion traps on the micro ion trap array plate having sidewalls arranged to cause preferential ion ejection.

8. The mass spectrometer of claim 5, wherein the micro ion trap array plates comprise three electrodes plates, the electrode plates being selectively metallized.

9. The mass spectrometer of claim 1, further comprising ion optic plates arranged within the first, ionization mass spectrometer module.

10. The mass spectrometer of claim 9, wherein the ion optic plates comprise arrays of lenses.

11. The mass spectrometer of claim 1, further comprising spacers between the plates, the spacers arranged to allow for gas conductance.

12. The mass spectrometer of claim 1, wherein the vacuum ultraviolet source is configured for different wavelengths.

13. The mass spectrometer of claim 1, wherein the vacuum ultraviolet source comprises a UV LED.

14. A method of detecting a substance comprising:

receiving a sample of an analyte into a housing through an inlet;

performing soft ionization mass spectrometry on the sample with a soft ionization mass spectrometer in the housing;

performing hard ionization spectrometry on the sample with a hard ionization spectrometer in the housing if needed; and generating a detection result from at least one of the soft ionization spectrometry and the hard ionization spectrometry.

15. The method of claim 14, further comprising displaying the result.

16. The method of claim 14, wherein performing soft ionization mass spectrometry comprises performing photoionization.

17. The method of claim 14, wherein performing hard ionization spectrometry comprises performing electron-impact ionization.

18. The method of claim 14, wherein the soft ionization mass spectrometry acts as a lead in to allow targeting of the hard ionization mass spectrometry.

19. The method of claim 14, wherein performing soft ionization mass spectrometry comprises performing mass spectrometry multiple times with different wavelengths.

* * * * *